US006868593B1

(12) United States Patent
Mitsuhashi et al.

(10) Patent No.: US 6,868,593 B1
(45) Date of Patent: Mar. 22, 2005

(54) TANDEM INTERLACING TEXTILE JET NOZZLE ASSEMBLY

(76) Inventors: Ryuji Mitsuhashi, 52-7, Takasu 2 Chrome, Misato-Shi, Saitama-Ken (JP), 341; Nicolas C. Sear, 1440 Idlewild Heath Dr., Winston-Salem, NC (US) 27106

( * ) Notice: Subject to any disclaimer, the term of this patent is extended or adjusted under 35 U.S.C. 154(b) by 0 days.

(21) Appl. No.: 09/654,138

(22) Filed: Sep. 1, 2000

Related U.S. Application Data

(60) Provisional application No. 60/155,323, filed on Sep. 22, 1999.

(51) Int. Cl.[7] ..... D02J 1/08
(52) U.S. Cl. ..... 28/271; 28/274
(58) Field of Search ..... 28/271, 273, 274, 28/275, 276, 282, 283, 247, 258, 220; 242/147 A, 417, 615.11; 226/97.1, 97.4, 97.3; 57/289, 290, 333, 350, 351, 908, 246, 206, 208; 264/167, 168, 282, 294, 211.12; 425/66

(56) References Cited

U.S. PATENT DOCUMENTS

| | | | | | |
|---|---|---|---|---|---|
| 3,115,691 | A | | 12/1963 | Bunting, Jr. et al. | |
| 3,309,752 | A | * | 3/1967 | Nuissl | 28/252 |
| 3,473,315 | A | * | 10/1969 | Le Noir | 28/271 |
| 3,474,510 | A | * | 10/1969 | Torsellini | 28/275 |
| 3,474,613 | A | * | 10/1969 | Joarder et al. | 57/350 |
| 3,563,021 | A | | 2/1971 | Gray | |
| 3,706,407 | A | * | 12/1972 | King et al. | 28/271 |
| 3,727,275 | A | * | 4/1973 | Ohayon | 28/271 |
| 3,898,719 | A | * | 8/1975 | Lloyd | 28/274 |
| 3,944,166 | A | * | 3/1976 | Hermanns | 28/271 |
| 3,956,807 | A | * | 5/1976 | Holland | 28/255 |
| 4,217,323 | A | * | 8/1980 | Foster et al. | 264/288.4 |
| 4,223,520 | A | * | 9/1980 | Whitted et al. | 57/350 |
| 4,251,904 | A | * | 2/1981 | Sano et al. | 28/274 |
| 4,253,299 | A | * | 3/1981 | Borenstein et al. | 28/274 |
| 4,345,425 | A | | 8/1982 | Negishi et al. | |
| 4,841,606 | A | | 6/1989 | Coons, III | |
| 5,010,631 | A | | 4/1991 | Ritter | |
| 5,146,660 | A | | 9/1992 | Ritter | |
| 5,184,381 | A | | 2/1993 | Coons, III et al. | |
| 5,275,618 | A | | 1/1994 | Koyfman et al. | |
| 5,398,392 | A | * | 3/1995 | Sano et al. | 28/276 |
| 5,481,787 | A | * | 1/1996 | Sano et al. | 28/276 |
| 5,763,076 | A | | 6/1998 | Coons, III et al. | |

* cited by examiner

*Primary Examiner*—Amy B. Vanatta

(57) ABSTRACT

An apparatus and method for improving multifilament textile yarn interlacing includes two spaced apart interlacing jet nozzles 2*a* and 2*b* positioned so that the yarn channels 4*a* and 4*b* of the two nozzles are aligned in a tandem relationship. High pressure air is injected into an upstream nozzle 2*a* with a velocity component tending to entrain or advance the yarn through the upstream nozzle 2*a*. High pressure air is injected into the downstream nozzle 2*b* with a velocity component tending to retard passage of the yarn through the downstream nozzle 2*b*.

19 Claims, 5 Drawing Sheets

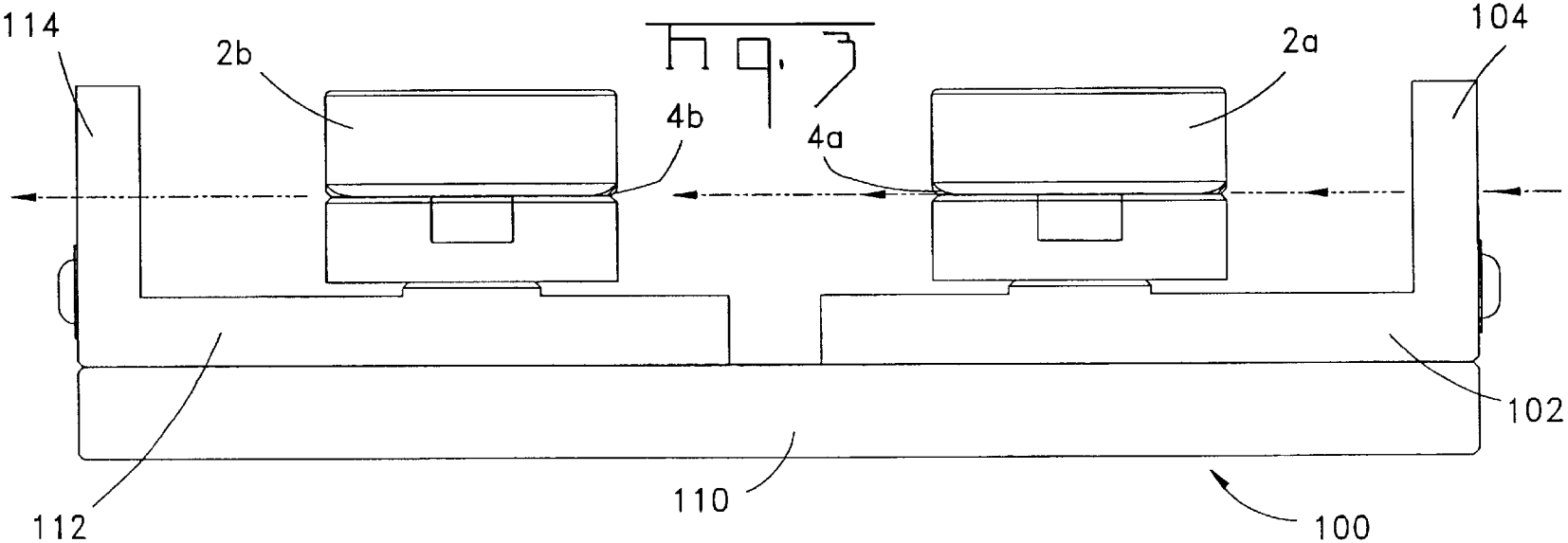
104
102
2a
100
4a
110
4b
2b
114
112
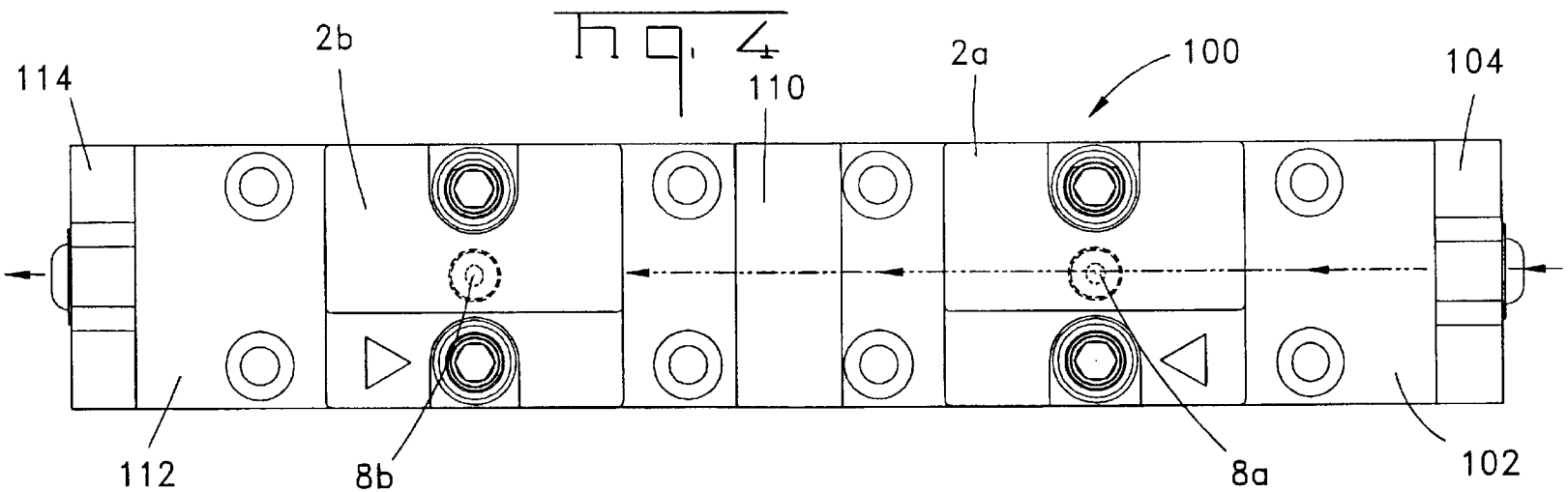
104
102
100
8a
2a
110
2b
8b
112
114

TANDEM INTERLACING TEXTILE JET NOZZLE ASSEMBLY

CROSS REFERENCE TO PROVISIONAL PATENT APPLICATION

This application claims the benefit of copending provisional patent application Ser. No. 60/155,323 filed Sep. 22, 1999.

BACKGROUND OF THE INVENTION

1. Field of the Invention

This invention is related to interlacing jets and jet nozzles that are used with multifilament textile yarns. More particularly this invention is related to the use of tandem jet nozzles to improve the quality of the interlaced textile yarn.

2. Description of the Prior Art

Multifilament textile yarn can be interlaced or entangled using interlacing jets in which a relatively high velocity airstream is injected transversely of a yarn channel in the jet nozzle. U.S. Pat. No. 5,010,631 and U.S. Pat. No. 5,146,660 disclose two interlacing jet nozzles. The turbulent flow created by injecting a relatively high velocity jet of air into a transverse yarn channel serves to interlace or entangle portions of a multifilament yarn.

In some applications only a single jet nozzle is used to interlace the multifilament yarn, but it has been found that two jet nozzles of this basic type can be placed in tandem so that the multifilament yarn transits one jet before entering the second coaxial jet. In these tandem applications, guides are placed in front of the upstream jet nozzle and after the downstream jet nozzle. It has been found that this tandem jet arrangement will result in greater yarn uniformity at higher speeds on the order of 5000 to 6000 meters per minute.

SUMMARY OF THE INVENTION

The purpose of the instant invention is to achieve even greater yarn quality than standard tandem jet configurations. This invention is suitable for use with jets having open treading slots, such as the jet nozzles referred to previously, as well as with other interlacing jet configurations A tandem interlacing jet assembly according to this invention comprises two jet nozzles. Each jet nozzle has a yarn channel and an air passage intersecting the corresponding yarn channel. The yarn channels of the first, and second jet nozzles are axially aligned so that the yarn transits the first yarn channel prior to transiting the second yarn channel. The air passage in the first or upstream jet nozzle is inclined relative to the first yarn channel in a direction to advance the yarn as the yarn passes through the first or upstream jet nozzle. The air passage in the second yarn channel is inclined relative to the second yarn channel to retard the yarn as the yarn passes through the second jet nozzle to improve yarn interlacing. The first jet thus comprises a forwarding jet and the second jet comprises a retarding jet. This jet assembly has been found to create an interlaced or entangled yarn of superior quality to that produced using a standard, prior art tandem interlacing jet assembly.

BRIEF DESCRIPTION OF THE DRAWINGS

FIG. 3 is a view of a tandem assembly of two of the jet nozzles positioned to interlace multiple fibers to form an improved yarn.

FIG. 4 is a top view of the tandem assembly shown in FIG. 3.

DETAILED DESCRIPTION OF THE PREFERRED EMBODIMENTS

Figure 1:
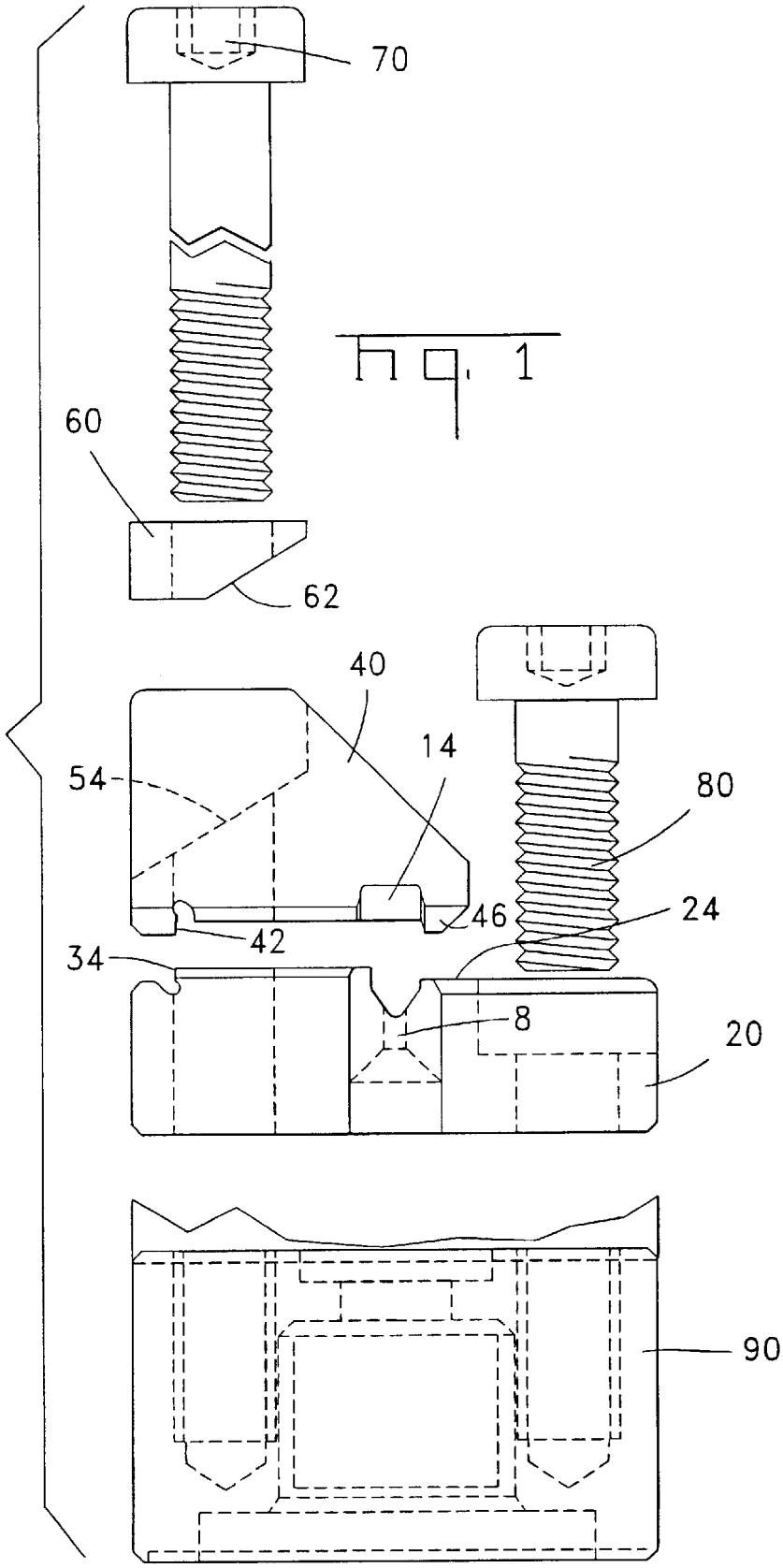
FIG. 1 is an exploded view of the components of a single interlacing jet nozzle that is used in the preferred embodiment of this invention.
Figure 2:
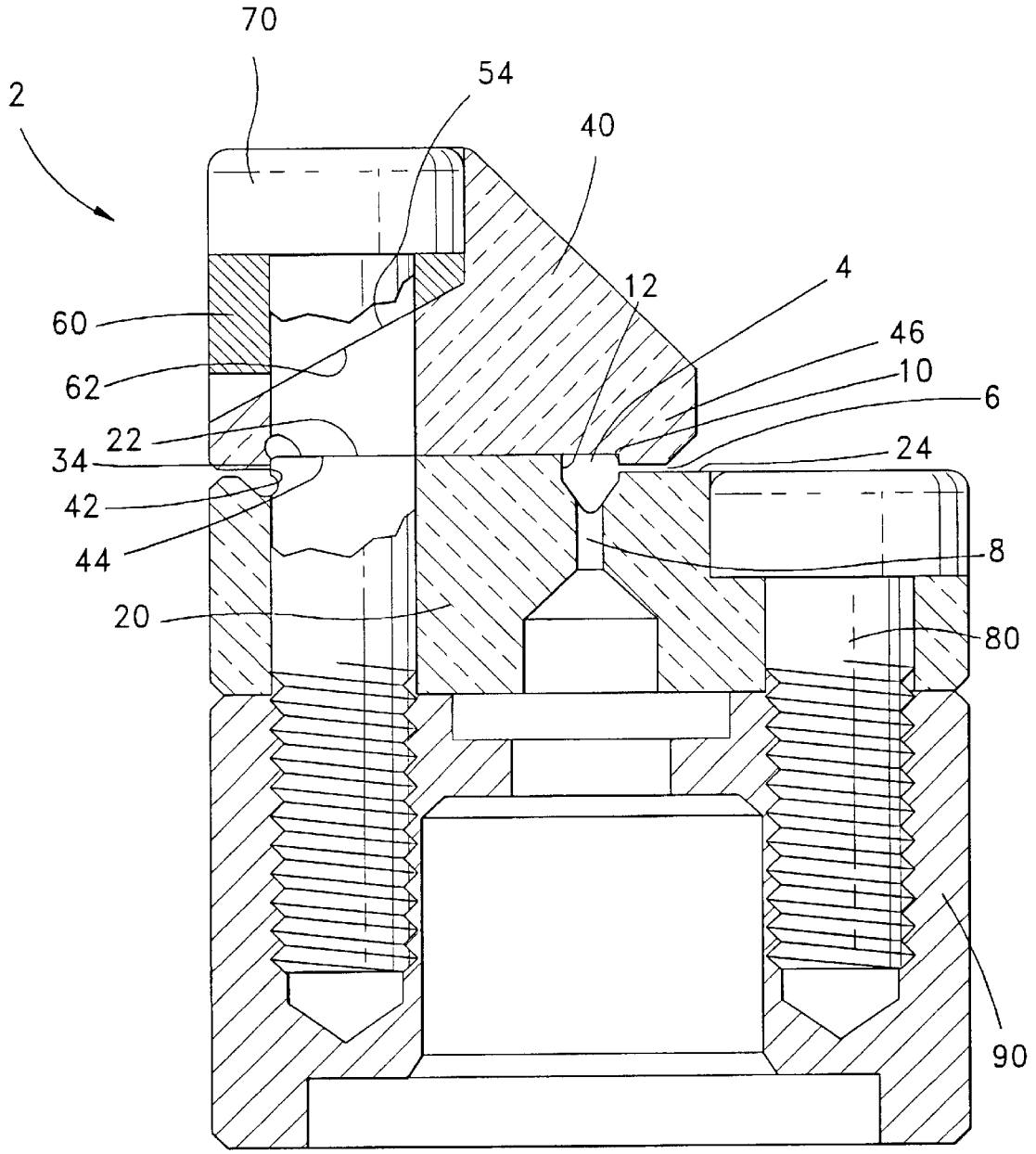
FIG. 2 is a cross sectional view of an assembled jet nozzle as shown in FIG. 1

Each of the individual jet nozzles, used in this invention and shown in FIGS. 1 and 2, comprises means for interlacing multifilament textile yarns as the yarns are drawn through a nozzle 2. A yarn channel 4 extends between opposite ends of the yarn channel and a threading slot 6 enters one side of the yarn channel 4 to permit yarn to be laced into the yarn channel. An air inlet 8 communicates with the yarn channel 4 between its ends. A source of high pressure air injects air into the yam channel 4 as multifilament yarn is drawn between the entrance and the exit of the yarn channel. The resulting turbulence results in interlacing or intermingling the yarn filaments.

The yarn channel 4 and the threading slot 6 are formed between a base 20 and a top plate 40, both of which are attached to a support 90 by a camming bolt 70 and a mounting bolt 80. Surfaces on the base 40 form a lower convex surface of the yarn channel 4 and one channel side wall 12. A side face 26 forms the portion of the other or remote side wall 10 that extends below the threading slot 6. The top of the yarn channel 4 and the portion of the first side wall 10 above the threading slot 10 are formed by the top plate 40. Both the base 20 and the top plate 40 are formed from a ceramic material such as a micro grain alumina ceramic having a grain size of 2–7 microns. It should be understood however that both the base 20 and the top plate 40 could be machined from a metal or fabricated from equivalent materials known to those skilled in the art.

The base 20 is generally rectangular in shape and has two flat top surfaces 22 and 24 on opposite sides of the yarn channel 4. The plane of the first top surface 22 is spaced above the plane of the second top surface 24 so that the second top surface, on the threading slot side of the yarn channel 4 is offset relative to the top surface 24 on the closed side of the yarn channel 4. In the preferred embodiment, these surfaces 22 and 24 are parallel, although the surface 24 could be inclined to provide a wider entrance to the threading slot 6.

The lower portion of the yarn channel 4 comprises a channel or recess in the top of the base 20 extending between opposite ends of the base 20, and therefore the nozzle 2. Lead in sections are of course provided on the ends of the base 20. The channel forming the lower portion of the yarn channel 4 separates the first base flat top surface 22 from the second base flat top surface 24. Two bolt holes 36 and 38 extend between the top a bottom surfaces of the base 20. A recess forms a base alignment shoulder 34 at one side of the top surface section 22. The inwardly facing surface of shoulder 34 extends between opposite ends of the base 20 and is spaced from the yarn channel 4. This alignment shoulder 34 will engage a corresponding surface on the top plate 40 when assembled to the base to form a means for precisely positioning the top plate 40 and the top plate lip 46 relative to the lower portion of the yarn channel 4 formed in the base 20. The groove at the base of the shoulder 34, between the shoulder and the base top surface 22 eliminates a sharp corner and thus eliminates or reduces stress concentrations.

Although referred to herein as top plate 40 , the upper portion of the nozzle 2 and the yarn channel 4 is formed by a block which has a thickness greater than that of the base 20 and which a generally trapezoidal section when viewed from the side as shown in FIG. 1. Except as otherwise discussed herein, the overall shape of the top plate 40 is not critical to the operation of nozzle 2. The top plate 40 has a width that is somewhat more than half the width of the base 20 and includes a flat lower surface 44 that extends between a top plate alignment shoulder 42 along one side and a lip 46 along the other side. Both the alignment shoulder 42 and the lip 46 project beyond the flat lower surface 44. The lip 46 and the portion of the lower surface 44 form portions of the yarn channel 4. The top plate lower surface 44 forms the top of the yarn channel 4, extending between the yarn channel sidewalls 10 and 12. The lip 46 has a side face 50 and a lower face 48 which extend between opposite ends of the top plate 40 with beveled ends 52 located at the entrance and the exit of the yarn channel 4. The side face 50 of lip 46 forms the portion of the yarn channel side wall 10 extending above the threading slot 6. The lower face 48 of the lip 46 forms the top of the threading slot 6 and is spaced from the base top surface 24, which forms the bottom of threading slot 6. The projecting alignment shoulder 42 is spaced from the yarn channel 6 and from the lip 46. When the top plate 40 is mounted on top of the base 20, the top plate alignment shoulder 42 engages the base alignment shoulder 34 to position the lip side face 50 in substantially the same plane as the base side face 26 extending below the threading slot 6. Therefore there will be no protruding corners either above or below the threading slot to fray, abrade or damage the yarn filaments as they are move about under the influence of high pressure air introduced into the yarn channel 4 though the inlet 8. The interlaced or intermingled yarn should therefore be of higher quality. The projecting top plate alignment shoulder 42 is shown in detail in FIG. 6 and its engagement with the recessed base alignment shoulder 34 as shown in FIG. 2. Although top plate shoulder 42 projects from the bottom of the top plate 40 and the base alignment shoulder 34 is recessed relative to the base upper surface, it should be understood that this relationship could be reversed. A stress reducing groove is also formed between the top plate aligning shoulder 42 and the top plate lower surface 44 to prevent stress concentration.

The base 20 and the top plate 40 are assembled and held together by a bolt 70 which extends through a bore hole in both members and secures them to a support 90. Bolt 70 is not threaded to either of these two members but the head of this bolt 70 clamps the top plate 40 to the base 20 and both members are then held in place by the engagement of the threads to the support 90. The base 20 is also held in place by a second bolt 80 which does not engage the top plate 40. The bolt 70 also serves as a camming bolt. A camming sleeve or camming washer 60, which comprises a cylindrical or tubular member having one inclined face 62 is mounted on the camming bolt 70, between the head of this bolt and the top plate 40. The lower end of the camming sleeve 60 is truncated so that excessive pressure will not be applied to the top plate 40 as the bolt 70 is tightened to bring shoulder 42 into engagement with shoulder 34 and the top plate 40 will not fracture or crack in the vicinity of shoulder 42. An inclined camming surface 54 surrounds the bore hole on the top plate 40. As the camming bolt 70 is tightened, the inclined surface 62 on the camming sleeve 60 engages the inclined camming surface 54 on the top plate 40 and causes the top plate 40 to shift laterally toward the yarn channel 4. This lateral movement brings the top plate alinement shoulder 42 into engagement with the base alignment shoulder 54. Since both of the alignment shoulders are precisely positioned relative to the yarn channel, the side face 50 of lip 46 will be in the same plane as the base side face 28 below the threading slot 6 when the bolt is full tight. In this way precise alignment is insured between the two faces of channel wall 10 which extend above and below the threading slot 6.

The exploded view in FIG. 1 and the section view of FIG. 2 show the manner in which the top plate 40 and the base 20 are assembled to the support 20. The base 20 can first be attached to the support 90 by the mounting bolt 80. The opening for the camming bolt 70 must be in line with the corresponding threaded hole in the support plate. The camming sleeve 60 is positioned between the top plate 40 and the head of the camming bolt 70. The camming bolt is then inserted through a top plate hole that is aligned with corresponding holes in the base 40 and the support 90. As the camming bolt 70 is tightened, the camming surface 62 on the camming sleeve 60 can slip relative to the opposed camming surface 54 on the top plate 40. Before the camming bolt 70 if full tight, the top plate will then move, due to this force exerted by sleeve 60 on top plate 40. The top plate 40 moves until the shoulder 42 abuts the shoulder 34. When these two shoulders are in abutment, the lip face 50 on the top plate 40 will be in the same plane as the base side face 26 below the threading slot 6. The yarn channel side 10 will then be formed by two coplanar surfaces 50 and 26, because of the fixed distances between each of these surfaces and the alignment shoulders on the top plate 40 and the base 20 respectively. Of course this coplanarity will be within conventional tolerances for ceramic components, but there will be no tolerance stackups to increase the offset between the two surfaces forming side wall 10.

Two of these jets 2 are shown in a tandem jet assembly 100 in FIGS. 3 and 4 for improving the quality of the interlaced multifilament yarn. A forward or upstream jet 2*a* is placed in alignment with a rear or downstream jet 2*b*. As shown in FIGS. 3 and 4 the yarn advances from the right to the left through the two tandem jets 2*a* and 2*b*. The yarn channels 4*a* and 4*b* of the two tandem jets are axially aligned. The threading slots for the two yarn channels 4*a* and 4*b* both face in the same direction so that the yam can be threaded from one side.

The upstream jet 2*a* is mounted on a bracket 102 that includes a conventional upright thread guide 104 which aligns the yarn with the channel 4*a*. The bracket 102 includes conventional means for mounting the jet 2*a* so that the air orifice intersecting the channel 4*a* is aligned with a source of high pressure air. Bracket 102 includes the mounting means shown as part of support 90 in FIGS. 1 and 2.

The downstream jet 2*b* is also mounted on a bracket 112 that also includes an upright thread guide 114 for guiding the yarn as it exits the tandem jet assembly 2. An air orifice in jet 2*b* is also positioned in communication with a source of high pressure air. The brackets 102 and 112 also mount the two jets 2*a* and 2*b* in spaced relationship on a base frame 110 that includes air passages communicating with the source of high pressure air. Air passages shown in support 90 in FIG. 2 also extend through brackets 102 and 112. Although the nozzles 2*a* and 2*b* are mounted on brackets 102, 112 and base frame 110 in the preferred embodiment, it should be understood that the nozzles could also be mounted in line on a conventional panel mounting system such as those currently manufactured by Barmag, Automatik, Reiter, Murata, and Toray.

Figure 5:
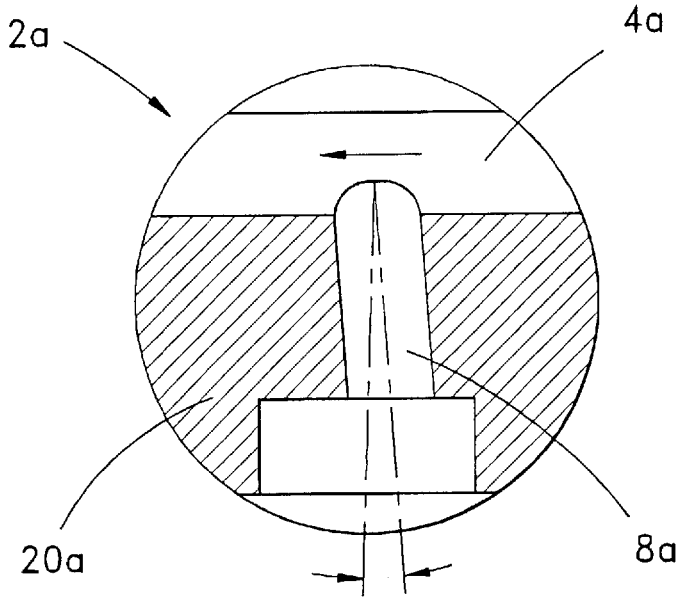
FIG. 5 is a partial sectional view of the forward jet nozzle shown in FIG. 3 showing the orientation of the forwarding jet orifice

Although the two jet nozzles 2*a* and 2*b* are each substantially the same as the jet nozzle 2 shown in FIGS. 1 and 2, the two nozzles 2*a* and 2*b* differ from each other in one important respect. Upstream nozzle 2*a* has a forwarding air orifice or passage 8*a* and downstream nozzle 2*b* has a retarding air orifice or passage 8*b*. The forwarding or advancing air orifice or passage 8*a* in jet nozzle 2*a*, as shown in FIG. 5, is tilted so that it intersects the axis of the yarn channel 4*a* at an acute angle relative to the direction traversed by the yarn (right to left as shown by the arrow in FIG. 5). In other words, the air orifice 8*a* is directed slightly away from the direction of travel of the yam and the airstream emerging from the forwarding air orifice 8*a* has a velocity component in the direction of yarn travel, which is indicated by the arrow in the yarn channel 4*a*. This velocity component is directed in the downstream direction toward the second nozzle 2*b*.

Figure 6:
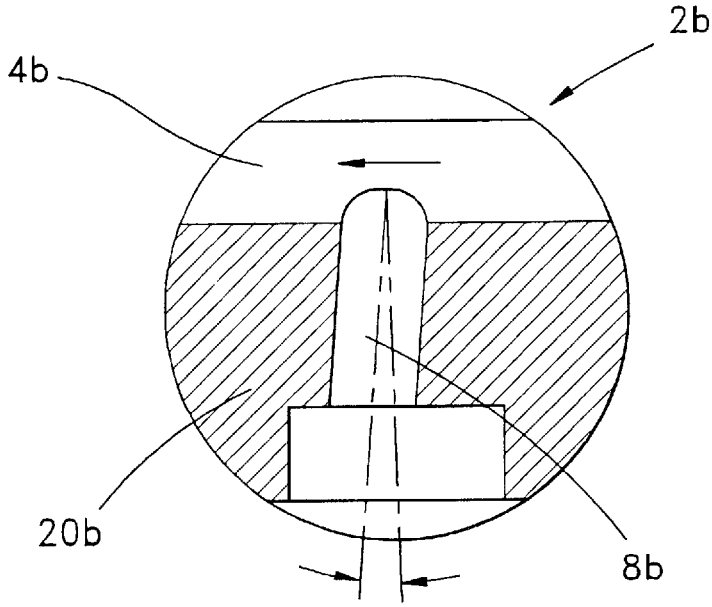
FIG. 6 is a partial sectional view of the trailing jet nozzle shown in FIG. 3 showing the orientation of the retarding jet orifice.

The air orifice 8*b* in the downstream or second nozzle 2*b* is also inclined relative to the direction of yarn travel, as indicated by the arrow in FIG. 6. This retarding air orifice 8*b* thus has a velocity component in a direction opposed to the direction of yarn travel. The combined effect of these two oppositely inclined airstreams emanating from air orifices 8*a* and 8*b* is to reduce the tension in the yarn between nozzle 2*a* and 2*b*. Thus any tensile force on the yarn in the open area between the two nozzles will be reduced. The forwarding or advancing jet nozzle 2*a* is also believed to reduce the drag on the multifilament yarn.

In the preferred embodiment of this invention, the air orifices 8*a* and 8*b* are each inclined six degrees relative to a vertical axis that is perpendicular to the axis of the respective yarn channels 4*a* and 4*b*. The included angle between the axes of the two orifices 8*a* and 8*b*, or the air streams emerging from these two orifices, is therefore twelve degrees. Of course the two air streams do not intersect, because they are located in separate nozzles. The respective orientations of the air orifices and the jet size will depend however upon fiber properties and process parameters and the included angle of twelve degrees has been found to be appropriate for one application of this invention. It is believed, however, that the included angle between the two orifices should not exceed twenty four degrees. In the preferred embodiment of this invention the cross sectional areas of the two orifices are the same, but the cross sectional areas and pressures need not be the same.

Although the jets 2*a* and 2*b* have the same basic configuration as shown in the jet nozzle 2 of FIGS. 1 and 2, this invention is not limited to use with jet nozzles or nozzle inserts having this configuration. Improvement in the quality of the interlaced yarn would also be realized by using other interlacing nozzles, which can also employ high pressure air inserted an angle, other than a right angle, into the main yarn channel of each of two separated nozzles.

Several improvements have been realized by positioning an advancing interlacing jet 2*a* in a tandem with a downstream or retarding interlacing jet 2*b*. By orienting jets in this manner it is generally possible to increase the number of knots per meter over that which can be obtained for similar configurations of a single interlacing jet or with tandem interlacing jets having two advancing configurations. For example, for partially oriented yarn it is possible to obtain between fourteen (14) and eighteen (18) knots per meter whereas for comparable configurations with high pressure air being injected at a downstream angle in the two tandem jets, between six (6) and eleven (11) knots were formed per meter. Furthermore longer, tighter knots with higher stability can be formed using this configuration of opposed tandem interlacing jets. For 235 denier, 36 filament partially drawn yarn at a yarn speed of 3200 m/min, improvements were realized using nozzles as shown in the preferred embodiment and for another jet nozzle when two jets were positioned with opposed forwarding and retarding orifices. Similar improvements are also possible with semi drawn yarn and fully drawn yarn. Opposed tandem interlacing jets can also markedly improve the yam speed when used with synthetic yarns which have been treated with stress relieving additives and/or high speed spinning techniques.

It should be understood that various parameters can be varied depending upon the multifilament yarn to be used. For example the optimum distance between the two jets is believed to be dependent upon the denier range of the yarn, the filament count and denier per filament (DPF).

Figure 7:
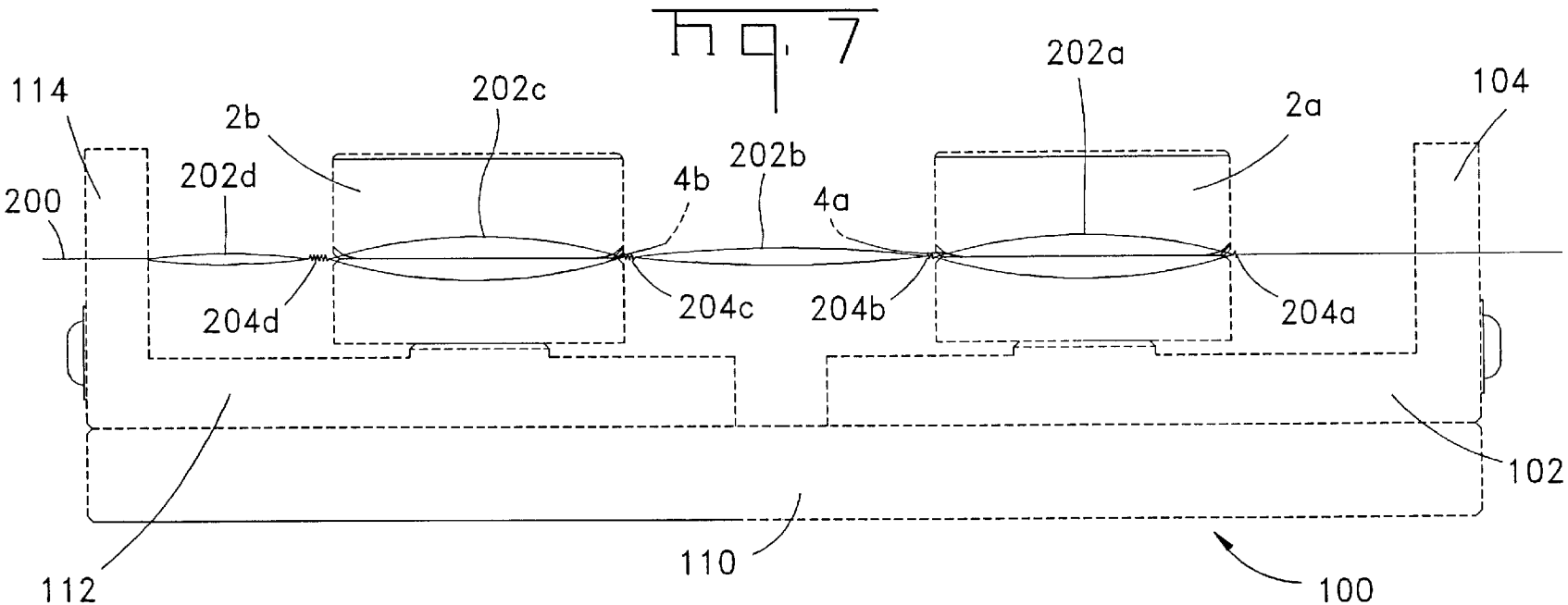
FIG. 7 is a schematic view illustrating the manner in which longer, tighter, more stable knots are formed between looped sections of a multifilament textile yarn.

The manner in which longer, tighter, more stable knots are formed between looped sections of a multifilament textile yarn is illustrated schematic view of FIG. 7. Although FIG. 5 shows a series of knots and loops at a single instant in time, the following explanation refers to formation of a single knot in a series of steps. For that reason, FIG. 7 should be understood as a schematic representation instead of a drawing showing a specific structure. When the multifilament yarn enters the first nozzle 2*a* with the jet being angled in a downstream direction as indicated by the arrow, the filaments in the yarn channel are entrained by the jet and a first section 204*a* of the knot is formed at the entrance to the first jet 2*a*. As the yarn advances through the first jet the yarn section 204*b*, which consists of the previous section 204*a* and an additional section of similar size will be formed at the exit of the first jet nozzle. The formation of loop 202*a* in the jet 2*a* contributes to the formation of the knot or plat sections 204*a* and 204*b*. As the yarn advances into the second nozzle 2*b*, having an inclined jet with a velocity component in the upstream direction as shown by the left arrow, a still longer third knot section 204*c*, comprising the previous sections formed at 204*a* and 204*b*, will be formed. Since the loop section 202*b*, between jets 4*a* and 4*b*, is unrestrained it will not retard formation of the extended knot section 204*c* that is caused by the movement of the looped section 202d within the downstream jet 2*b*. A final even longer knot section 204*d* is formed at the exit of the second nozzle 2*b*, and this knot section 204*d* includes the portions of the specified knot formed at sections 204*a*, 204*b*and 204*c*. This explanation is believed to be accurate, although other explanations of the improvement in knot formation can not be excluded.

Although the configuration shown and discussed with reference to FIGS. 1–7 comprises the preferred embodiment of this invention, it is however merely representative of other tandem jet assemblies that can also benefit for the relative orientation of the jets of air entering the separate yam channels of a tandem jet assembly. The invention is therefore defined not by the representative embodiment shown herein, but by the following claims.

We claim:

1. A tandem interlacing jet assembly for interlacing a textile yarn comprising first and second interlacing jet nozzles having aligned yarn channels through which the textile yarn passes, initially through the first interlacing jet nozzle and subsequently through the second interlacing jet nozzle, wherein a relatively high velocity air stream is introduced into the yarn channel of only the second interlacing jet nozzle in an orientation to resist the passage of the textile yarn through the second interlacing jet nozzle.

2. The tandem interlacing jet assembly of claim 1 wherein the relatively high velocity air stream is introduced transversely into the yarn channel of the second interlacing jet nozzle.

3. The tandem interlacing jet assembly of claim 2 wherein the relatively high velocity air stream is introduced into the yam channel of the second interlacing jet nozzle between an entrance and an exit of the second interlacing jet nozzle at an angle closer to perpendicular relative to the yarn channel than to parallel relative to the yarn channel.

4. The tandem interlacing jet assembly of claim 1 wherein an air passage intersects the yarn channel of the second interlacing jet nozzle at an angle the relatively high velocity air stream being introduced through the air passage into the yarn channel of the second interlacing jet nozzle.

5. The tandem interlacing jet assembly of claim 4 wherein the air passage intersecting the second interlacing jet nozzle yarn channel is inclined toward the entrance to the second interlacing jet nozzle yarn channel.

6. The tandem interlacing jet assembly of claim 1 wherein the first interlacing jet nozzle comprises a yarn advancing interlacing jet nozzle and the second interlacing jet nozzle comprises a retarding interlacing jet nozzle.

7. The tandem interlacing jet assembly of claim 1 wherein the first and second interlacing jet nozzles are spaced apart so that the yarn is exposed between the first and second interlacing jet nozzles.

8. The tandem interlacing jet assembly of claim 7 wherein the first and second interlacing jet nozzles are mounted on a frame with yam guides located in front of the first interlacing jet nozzle and aft of the second interlacing jet nozzle.

9. The tandem interlacing jet assembly of claim 8 wherein yarn guides are only located before the first interlacing jet nozzle and after the second interlacing jet nozzle so that the yarn is unsupported between the first and second interlacing jet nozzles.

10. The tandem interlacing jet assembly of claim 1 wherein a relatively high velocity air stream is injected into the yarn channels in both the first aid second interlacing jet nozzles, pressure injecting air streams into each interlacing jet nozzle being equal.

11. A tandem interlacing jet assembly for interlacing textile yarn comprising first and second interlacing jet nozzles, each interlacing jet nozzle having a yarn channel and an air passage intersecting the corresponding yarn channel, the yarn channels of the first and second interlacing jet nozzles being axially aligned so that the yarn transits the first yarn channel prior to transiting the second yarn channel, the air passage in only the first interlacing jet nozzle being inclined relative to the first yarn channel in a direction to advance the yarn as the yarn passes through the first interlacing jet nozzle, the air passage in only the second interlacing jet nozzle being inclined relative to the second yarn channel to retard the yarn as the yarn passes through the second interlacing jet nozzle to improve yarn interlacing.

12. The tandem interlacing jet assembly of claim 11 wherein the air passage in the first interlacing jet nozzle is inclined toward an exit or the first yarn channel and away from an entrance of the first yarn channel.

13. The tandem interlacing jet assembly of claim 12 wherein the air passage in the second interlacing jet nozzle is inclined toward an entrance of the second yarn channel and away from an exit of the second yarn channel.

14. The tandem jet assembly of claim 13 wherein the air passages in the first and second interlacing jet nozzles are oriented to have an included angle of approximately twelve degrees.

15. An improved process for interlacing multiple yarn filaments to form an interlaced multifilament yam comprising the steps of positioning the multiple yarn filaments in aligned yarn channels of two aligned, spaced apart, interlacing jet nozzles, injecting air at a relatively high velocity transversely into an upstream interlacing jet nozzle yarn channel with the air being injected into the upstream interlacing jet nozzle yarn channel only in a direction tending to advance yarn filaments through the upstream yarn channel and injecting air at a relative high velocity transversely into a downstream interlacing jet nozzle yarn channel with the air being injected into the downstream jet nozzle yarn channel only in a direction tending to retard yarn filaments through the downstream yarn channel to improve the quality of the interlaced multifilament yarn.

16. A tandem interlacing jet assembly for interlacing a textile yarn comprising first and second interlacing jet nozzles having axially aligned yarn channels through which the textile yarn passes, initially through the first interlacing jet nozzle and subsequently through the second interlacing jet nozzle, the jets being spaced apart by a predetermined space, wherein first and second high velocity air streams are introduced respectively into the first and second yarn channels, the First and second high velocity air steams being oriented to reduce tension on the textile yarn transiting between the first and second interlacing jet nozzles relative to other portions of the textile yarn to improve jet interlacing.

17. The tandem interlacing jet assembly of claim 16 wherein the first and second high velocity air streams each intersect the respective yarn channels at an angle other than 90°, the first and second air streams being inclined toward each other.

18. The tandem interlacing jet assembly of claim 17 including a yarn guide upstream of the first interlacing jet nozzle and a yarn guide downstream of the second interlacing jet nozzle, the space between the first and second interlacing jet nozzles being free of yarn guides so textile yarn between the first and second interlacing jet nozzles is relatively unrestrained.

19. A method of forming an interlaced multifilament textile yarn having a generally evenly spaced series of knots with loops extending between the knots, the yarn being interlaced in axially aligned, tandemly positioned first and second interlacing jet nozzles, each nozzle having a yarn channel with a jet entering transversely into the yarn channel, the knots being formed by;

forming a first section of a specified knot in a series of similar knots at an entrance of the first interlacing jet nozzle in which a first jet enters a first yarn channel at an angle with a component in a downstream direction;

forming a second section of the specified knot at an exit of the first yarn channel to elongate the knot;

forming a third section of the specified knot at an entrance of the second interlacing jet nozzle in which a second jet enters a second yarn chancel at an angle with a component in an upstream direction to further elongate the knot; and forming a fourth section of the knot at an exit of the second interlacing jet nozzle to still further elongate the specified knot in order to form longer tighter knots with higher stability.

* * * * *